United States Patent [19]

Shoemaker, Jr.

[11] Patent Number: 5,024,350

[45] Date of Patent: Jun. 18, 1991

[54] DISPENSING APPARATUS

[76] Inventor: Stephen P. Shoemaker, Jr., 123 International Boardwalk, Redondo Beach, Calif. 90277

[21] Appl. No.: 462,836

[22] Filed: Jan. 10, 1990

[51] Int. Cl.[5] ..... G07F 11/36

[52] U.S. Cl. ..... 221/75; 221/94; 221/152

[58] Field of Search ..... 221/75, 93, 94, 123, 221/129, 131, 152, 153

[56] References Cited

U.S. PATENT DOCUMENTS

| | | | |
|---|---|---|---|
| 2,272,859 | 2/1942 | Wilsey | 221/129 X |
| 2,359,182 | 9/1944 | Wilsey | 221/129 X |
| 3,653,540 | 4/1972 | Offutt | 221/75 |
| 4,018,359 | 4/1977 | Lambert | 221/75 X |
| 4,560,088 | 12/1985 | Tan | 221/75 |

*Primary Examiner*—Robert P. Olszewski
*Assistant Examiner*—Dean A. Reichard
*Attorney, Agent, or Firm*—Brown, Martin, Haller & McClain

[57] ABSTRACT

A dispensing apparatus for dispensing items from a plurality of dispensers in one or more vending or amusement machines includes a plurality of elongate support members each having a rotatably mounted support plate at one end. Items are releasably supported by the support member so that one item is dispensed from the free end of the support member for each complete revolution. A single drive gear motor operates all of the support members and is connected to each support plate via a series of driven rollers or pulleys and a continuous belt or chain extending around the rollers. Each driven roller is drivably connected to a respective one of the support plates via a clutch. A releasable stop mechanism is associated with each support plate for releasably engaging the plate to prevent it from rotating. An actuator controls release of the respective support plates for rotation through one revolution, and one or more selected plates may be released at any one time.

11 Claims, 2 Drawing Sheets

DISPENSING APPARATUS

BACKGROUND OF THE INVENTION

1. Field of the Invention

The present invention relates generally to dispensing apparatus of the type found in automatic vending machines as well as amusement devices or games of the coin-operated type in which a player uses skill in order to achieve an objective of the game, and wins a small prize item if successful.

2. Description of Related Art

In both vending and amusement machines, items such as small toys or other articles must be dispensed automatically one at a time, either in response to simply depositing the required coin or token, or in response to detection of a "WIN" situation. Typically, each machine includes one or more dispensing systems into which a plurality of items to be dispensed are loaded, and each system includes a gear motor for driving the dispenser to dispense an item in response to the appropriate signal. One such known dispensing system is of the rotating spring type, in which a plurality of toys or other items are suspended from a coil spring which is rotatably supported at one end and free at the opposite end. A gear motor is connected to the spring and is activated in response to a control pulse. As the spring rotates, items will be dispensed one at a time from the end of the spring. A cam mechanism which rotates with the spring activates a switch after one revolution which stops the motor so that only one item is dispensed.

SUMMARY OF THE INVENTION

It is an object of this invention to provide an improved dispensing apparatus.

According to the present invention, a dispensing apparatus is provided for dispensing items from a plurality of dispensers in one or more vending or amusement machines. Each dispenser comprises a support assembly for releasably supporting a plurality of items to be dispensed one at a time, the support assembly being rotatable between a supporting position and a dispense position in which one item is released for dispensing to a customer. A single drive gear motor is linked by a transmission path to each of the support assemblies, and a releasable stop in the transmission path to each support assembly controls the drive transmission to that assembly. A control device or actuator is provided for controlling each stop to selectively actuate one or more support assemblies to dispense an item.

In the preferred embodiment of the invention, each support assembly comprises a coil spring or other helical or screw-type dispenser having a rotatably mounted support plate at one end. The other end of the spring is free, and the spring is supported generally horizontally. A plurality of items to be dispensed are suspended along the length of the spring, one per turn of the spring, so that rotation of the spring through one complete revolution results in dispensing of one item. A stop member is mounted adjacent the support plate for movement between a first position in which it prevents rotation of the plate and a second, retracted position in which the plate is free to rotate. An actuator controls movement of the stop member between its two positions.

The single drive gear motor is preferably linked to all of the support plates by means of an endless belt transmission. In the preferred embodiment of the invention, the endless belt extends around a drive roller driven by the motor and each support plate is connected via a slip clutch mechanism to a respective driven roller or pulley member around which the belt extends. A suitable controller controls operation of the respective stop members to control which of the dispensers is actuated at any time. When a win or dispense signal is received for one of the dispensers, the controller activates the respective actuator of that dispenser to retract its stop member, simultaneously turning the gear motor on. The other dispensers will not operate since their stop members will be in the operative position preventing rotation. Thus, the clutches associated with each of these dispensers will slip, and no items will be dispensed. In the meantime, the support plate of the actuated dispenser is free to rotate. Preferably, the stop member is biased towards the operative position and the support plate has a notch or opening for receiving the stop member to cut off the drive after one complete revolution, so that only one item is dispensed each time the motor is actuated. If a win or dispense signal is received simultaneously for more than one dispenser, the controller simply retracts the stop member from each of the selected dispensers, allowing one or more dispensers to dispense an item.

This dispenser arrangement is relatively inexpensive since only one drive gear motor is needed for any number of dispensers. The drive gear motor is typically the most expensive part of a dispenser apparatus, so this arrangement results in considerable cost savings, particularly where a relatively large number of dispensers are involved which would previously all have needed a separate drive gear motor.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 2:
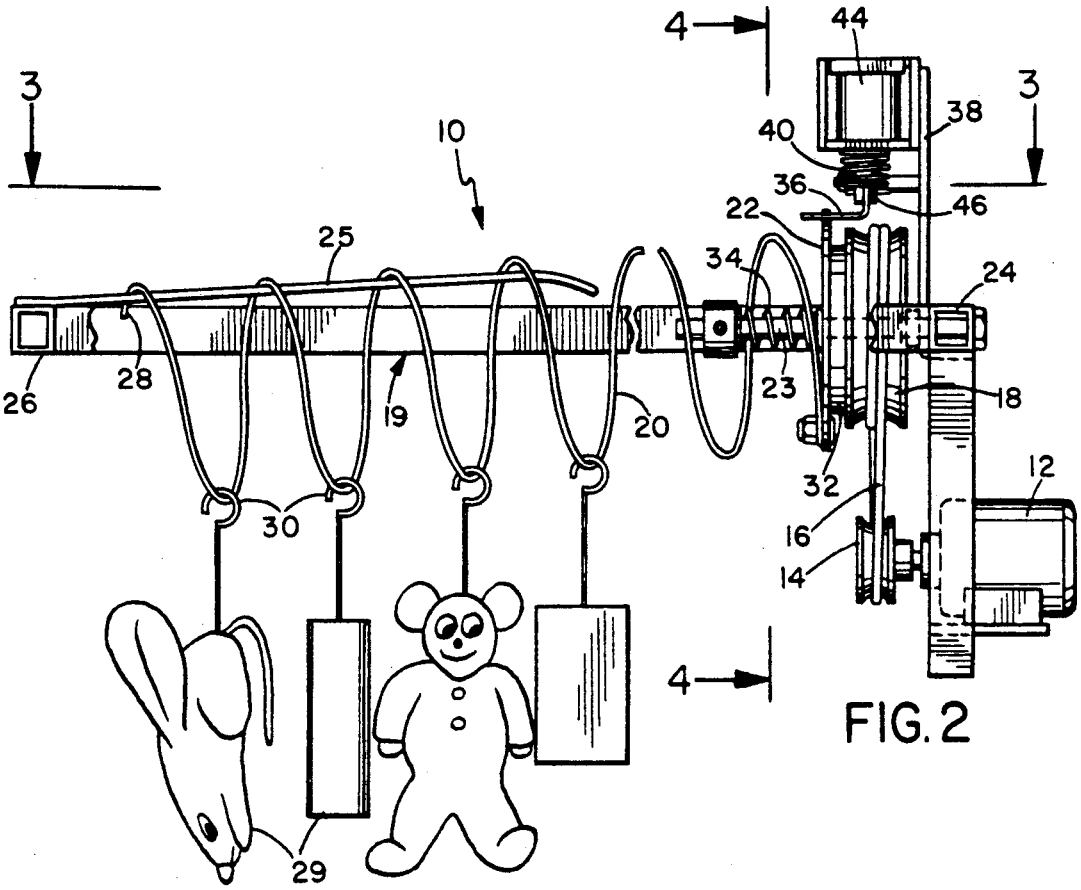
FIG. 2 is a side elevation view of a single dispensing unit forming part of the dispensing system, with a portion of the support frame cut away.
Figure 3:
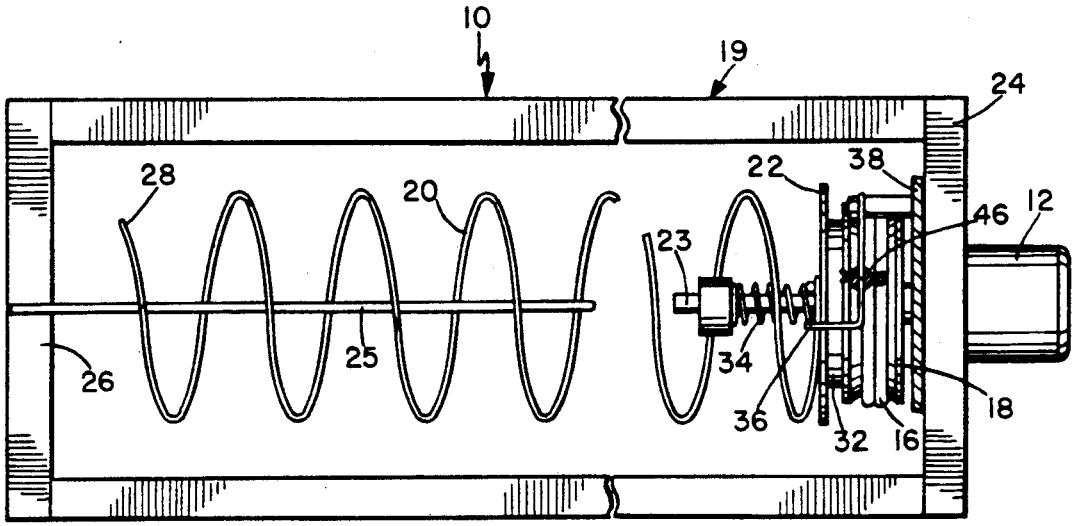
FIG. 3 is a sectional view taken on line 3—3 of FIG. 2.
Figure 1:
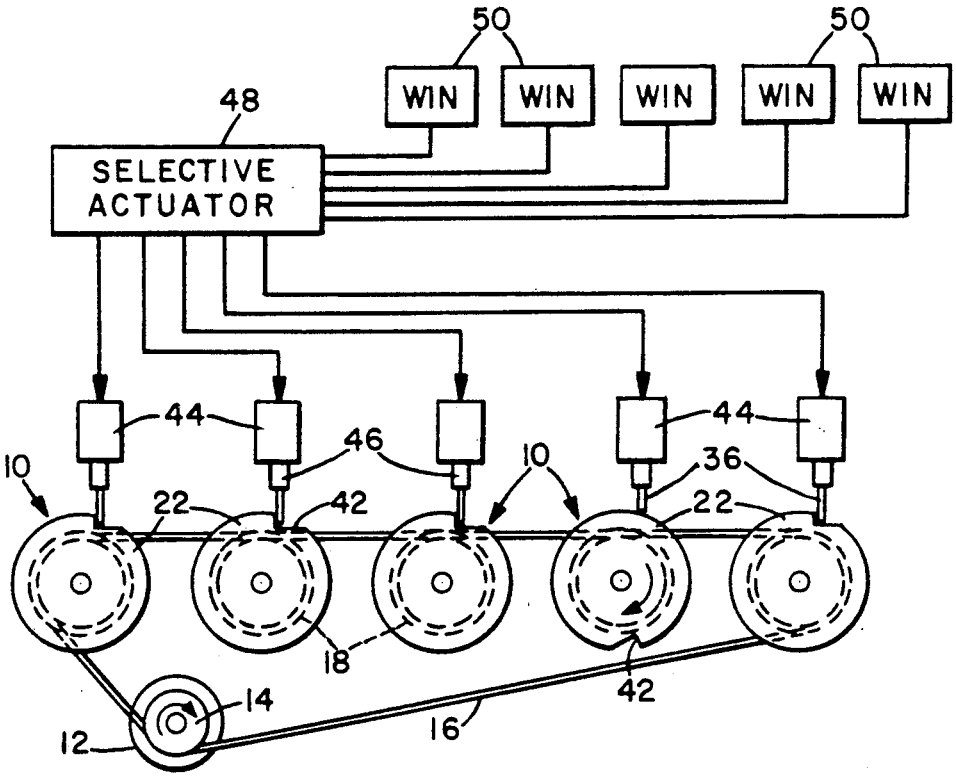
FIG. 1 illustrates schematically a dispensing system according to a preferred embodiment of the invention.

FIG. 1 of the drawings illustrates schematically a multiple dispensing apparatus according to a preferred embodiment of the invention in which a plurality of dispenser units 10 are driven from a common drive gear motor 12. FIGS. 2 and 3 illustrate one of the dispenser units 10 in more detail. Although five dispenser units are provided in the system illustrated in FIG. 1, in practice any number of dispenser units may be provided in the same system, eliminating the need for separate drive motors associated with each individual dispenser.

The drive gear motor 12 has an output drive connected to drive roller 14, and an endless belt or chain 16 extends around drive roller 14, and is looped around a series of driven rollers or pulley members 18, one each associated with each of the dispenser units. Thus, operation of gear motor 12 will result in rotation of each of the rollers 18.

The entire dispenser apparatus is preferably mounted on a suitable support such as frame 19 as illustrated in the drawings. Each dispenser unit 10 is mounted on a separate rectangular section of the framework, as best illustrated in FIGS. 2 and 3. Each unit 10 basically comprises a coil spring dispenser 20 secured at one end to a support or cam plate 22 which is rotatably mounted on mounting pin or rod 23 projecting from one limb 24 of the rectangular framework section.

The spring 20 is supported in a generally horizontal orientation by means of support rod 25 extending from the opposite limb 26 of the support frame within the spring towards the inner or secured end of the spring. The opposite or outer end 28 of the spring is free. If the support rod is long, it may be connected to main axle rod 23 for additional support. A plurality of items 29 such as toys or other items to be dispensed are suspended from the spring 20 via suitable hook members 30, with one item suspended from each coil or turn of the spring.

The driven roller 18 is also rotatably mounted on the rod 23 between the cam plate 22 and limb 24. A slip clutch 32 is mounted between the cam plate and driven roller 18, and spring 34 urges the cam plate and slip clutch into operative engagement.

Figure 4:
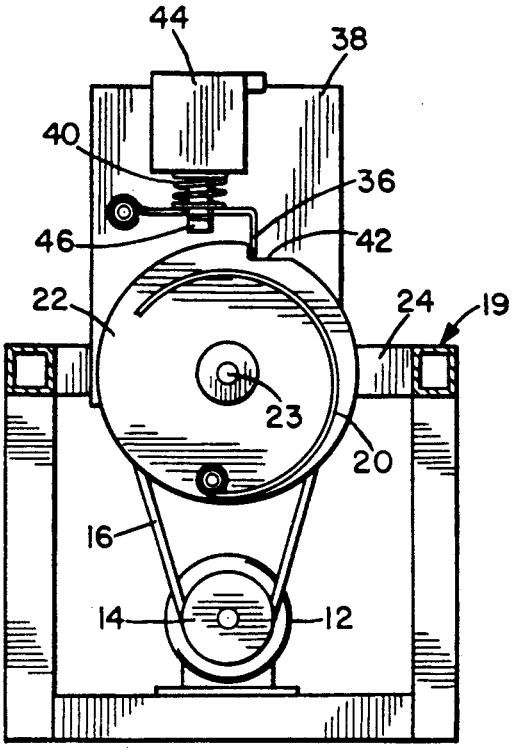
FIG. 4 is a sectional view taken on line 4—4 of FIG. 2.
Figure 5:
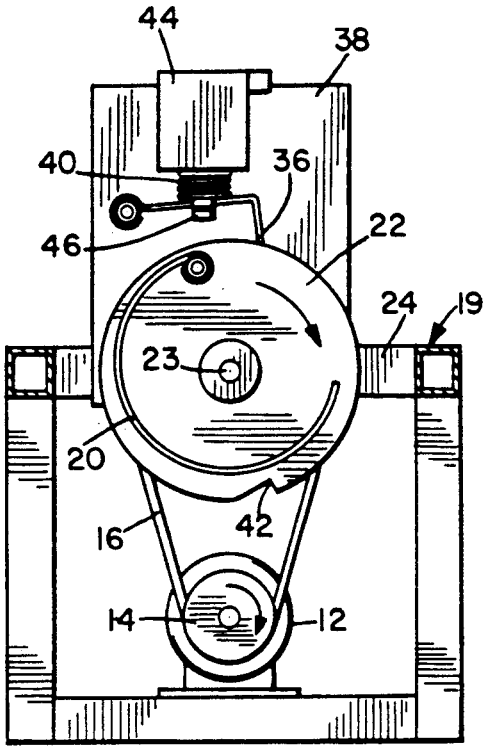
FIG. 5 is a view similar to FIG. 4, but with the stop mechanism released to rotate the dispenser.

A stop member or pin 36 is pivotally mounted on a back plate 38 secured to frame 19 and is urged by spring 40 towards its operative position in which it engages a notch 42 in the cam plate to prevent rotation of the plate (see FIG. 4), and thus prevent rotation of the spring dispenser. A solenoid actuator 44 also mounted on the back plate 38 has a plunger 46 linked to pin 36. Pin 36 extends transversely through a slot in the end of plunger 46, as illustrated in FIG. 3, and is retained in the slot via retainer pin 37. Retraction of plunger 46 into the position illustrated in FIG. 5 raises the stop member 36 and releases the cam plate for rotation. Release of the plunger results in biassing of the pin 36 by spring 40 back into biassed engagement with the periphery of the cam plate.

A suitable common actuator or controller 48 (see FIG. 1) controls operation of the respective solenoid actuators 44 according to signals received from coin deposit detectors or win detection circuitry 50 of a standard nature associated with each of the dispensers. For example, where the dispensers are associated with a series of amusement devices, each device will have appropriate circuitry or detectors for detecting a "WIN", i.e. when a user has achieved the objective of the game. This will result in a signal pulse which will be detected by the actuator 48, which may consist of a suitably programmed microprocessor or controller or of appropriate logic circuitry, as is known in the field. The actuator then emits a pulse to the appropriate solenoid to retract its plunger, lifting the pin away from the cam plate to allow the plate, and thus the spring dispenser, to rotate. The gear motor may be actuated at the same time or may run continuously whenever the amusement device or devices are in use. The actuator may simultaneously activate one or more dispensing units, dependent on signals received from the win or coin detection circuitry.

The gear motor will simultaneously rotate all of the driven rollers 18 and any cam plate which is free to rotate due to the retraction of its stop pin away from notch 42. The other cam plates will be prevented from rotation by the engagement of their stop pins in the associated notches, and their clutches will slip. The rotating cam plate or plates will rotate their associated spring or springs through one complete revolution. At the same time, the solenoid plunger will be released, biasing the pin back towards the cam plate. As soon as the cam plate reaches the position in which the notch is aligned with the pin, the pin is biased back into the notch, the rotation stops, and the clutch starts to slip. Thus, once actuated, the cam plate rotates through one complete revolution before being stopped again. This results in rotation through one turn of the spring, dispensing the outermost toy or item from the end of the spring.

This dispensing apparatus can be used anywhere where a plurality of different items are to be selectively dispensed from different dispensers, for example, or where a plurality of amusement devices or games which distribute prizes are provided, or where a single game has a plurality of dispensers for dispensing different prize items at the selection of the user. It avoids the need for an expensive drive gear motor associated with each individual dispenser, but instead uses only a single drive gear motor to drive any required number of dispensers. All that is needed is a drive system comprising one drive gear motor and one endless belt or chain for the entire system, and a clutch/solenoid unit for each dispenser. Since the clutch/solenoid unit costs about 25% of the cost of a drive gear motor, considerable cost savings can be realized particularly where a relatively large number of dispensers are operated in the system.

Although a preferred embodiment of the invention has been described above by way of example only, it will be understood by those skilled in the field that modifications may be made to the disclosed embodiment without departing from the scope of the invention, which is defined by the appended claims.

I claim:

1. A dispensing apparatus for dispensing items at a plurality of locations, comprising:

a series of support assemblies each comprising means for releasably supporting a plurality of items to be dispensed;

each support assembly comprising a support frame, a support plate rotatably mounted on said support frame for rotation between supporting position and a dispense position in which one item is released and dispensed, and an elongate support member secured at one end to said support plate and extending from the support plate to support a plurality of items to be dispensed;

a single drive means for rotating all of said support plates towards said dispense position;

transmission means for drivably connecting said drive means to each support plate along a transmission path;

releasable stop means in the transmission path to each support assembly for selectively cutting off the drive to that assembly, said stop means including a stop member adjacent each support plate and actuator means for moving said stop member between a first position engaging said support plate to prevent rotation of said plate and a second position retracted away from said support plate to allow rotation of said support plate; and control means for controlling each stop means to selectively release one or more of said stop means for movement into said retracted position spaced from said support plate for selectively actuating one or more of said support assemblies to dispense an item.

2. The apparatus as claimed in claim 1, wherein said support member comprises an elongate spiral member having a rotatably mounted support plate at one end, the opposite end of said spiral member being free, and successive turns of said spiral member comprising means for supporting at least one item to be dispensed so that rotation of said spiral member through one revolution results in dispensing of at least one item from the free end of said member.

3. The apparatus as claimed in claim 2, wherein said spiral member comprises a spring, said support means further comprising suspension means for suspending items from successive turns of the spring.

4. The apparatus as claimed in claim 1, wherein said drive means comprises a single drive gear motor, said transmission means including a series of driven rollers each associated with a respective one of said support assemblies, a continuous belt extending from said drive gear motor around each of said driven rollers, and clutch means between each driven roller and the respective support plate for transmitting rotation of said driven roller to said support plate.

5. A dispensing apparatus for dispensing items at a plurality of locations, comprising:

a series of support assemblies each comprising means for releasably supporting a plurality of items to be dispensed;

each support assembly being rotatable between a supporting position and a dispense position in which one item is released and dispensed;

a single drive means for driving all of said support assemblies towards said dispense position;

transmission means for drivably connecting said drive means to each support assembly along a transmission path;

releasable stop means in the transmission path to each support assembly for selectively cutting off the drive to that assembly;

control means for controlling each stop means to selectively release one or more of said stop means for selectively actuating one or more of said support assemblies to dispense an item;

said drive means comprising a single drive gear motor, said transmission means including a series of driven rollers each associated with a respective one of said support assemblies, a continuous belt extending from said drive gear motor around each of said driven rollers, and clutch means between each driven roller and the respective support assembly for transmitting rotation of said driven roller to said support assembly; and each support assembly including a rotatably mounted support plate, said clutch means being sandwiched between said support plate and said driven roller, said support plate having a recess and said stop means comprising a stop member moveable between a first position extending into said recess for preventing rotation of said support plate and a second position retracted from said recess to allow rotation of said support plate, and an actuator for controlling movement of said stop member between said two positions.

6. The apparatus as claimed in claim 5, wherein said actuator comprises a solenoid.

7. A dispensing apparatus for dispensing items at a plurality of locations, comprising:

a series of support assemblies each comprising means for releasably supporting a plurality of items to be dispensed;

each support assembly being rotatable between a supporting position and a dispense position in which one item is released and dispensed;

a single drive means for driving all of said support assemblies towards said dispense position;

transmission means for drivably connecting said drive means to each support assembly along a transmission path;

releasable stop means in the transmission path to each support assembly for selectively cutting off the drive to that assembly;

control means for controlling each stop means to selectively release one or more of said stop means for selectively actuating one or more of said support assemblies to dispense an item; and each support means including a support frame, a support plate rotatably mounted on said frame, and an elongate support member secured at one end to said support plate and extending from said support plate to support a plurality of items to be dispensed between said one end and its opposite, free end, said transmission means including a plurality of driven rollers and continuous belt means drivably connecting each of said driven rollers to said single drive means, each driven roller being rotatably mounted on said support frame adjacent a respective one of said support plates, and slipping clutch means being sandwiched between each driven roller and the adjacent support plate for normally transmitting rotation of said driven roller to said support plate, said stop means comprising means for selectively preventing rotation of said support plate.

8. The apparatus as claimed in claim 7, wherein each support plate has a recess, and said stop means includes a stop member adjacent each support plate and actuator means for moving said stop member between an advanced position engaging said recess to prevent rotation of said support plate and a retracted position allowing rotation of said support plate for at least one complete revolution of said support member.

9. The apparatus as claimed in claim 8, wherein said recess comprises a single notch on the outer periphery of said support plate, said stop means including biasing means for biassing said stop member against the outer periphery of said support plate, said control means comprising means for emitting at least one control pulse to operate at least one of said actuator means to retract the associated stop member and release said support plate for rotation, and for subsequently releasing said stop member before one complete revolution of said support plate for biasing against the outer periphery of said support plate to engage in said notch and stop said rotation after one complete revolution.

10. A dispensing apparatus for dispensing items from a plurality of dispensers, comprising:

a single drive gear motor;

a plurality of elongate dispenser members each having a rotatably mounted support plate at one end and being free at the opposite end, each dispenser member comprising means for releasably supporting a series of items to be dispensed and for dispensing one item from its free end for each complete revolution of said dispenser member;

transmission means for drivably connecting said drive motor to each of said rotatable support plates, including a series of driven rollers, each of said driven rollers being associated with a respective one of said support plates, clutch means between each driven roller and the associated support plate, and linkage means drivably connecting said motor to each of said driven rollers;

stop means associated with each support plate for selectively preventing rotation of said support plate, said stop means being movable between an operative position engaging said support plate to prevent rotation of said plate and a retracted position spaced away from said plate and allowing said plate to rotate; and actuator means for controlling operation of said stop means to allow one or more selected support plates and dispenser members to rotate through one complete revolution.

11. Apparatus as claimed in claim 10, wherein each support plate has a recess and said associated stop means comprises a respective stop member adjacent each support plate moveable into an operative position engaging said recess to prevent rotation of said plate.

* * * * *